US006863275B2

(12) United States Patent
Chiu et al.

(10) Patent No.: US 6,863,275 B2
(45) Date of Patent: Mar. 8, 2005

(54) MATCHING CARD GAME AND METHOD FOR PLAYING THE SAME

(75) Inventors: Pit Man Chiu, New Territories (HK); Man Hon Wong, New Territories (HK); Sung Pui Chiu, Kowloon (HK)

(73) Assignee: PM Square Limited, Kwun Tong (HK)

( * ) Notice: Subject to any disclaimer, the term of this patent is extended or adjusted under 35 U.S.C. 154(b) by 0 days.

(21) Appl. No.: 10/667,018

(22) Filed: Sep. 19, 2003

(65) Prior Publication Data

US 2004/0056421 A1 Mar. 25, 2004

Related U.S. Application Data

(60) Provisional application No. 60/412,938, filed on Sep. 19, 2002.

(51) Int. Cl.[7] ..... A63F 1/00
(52) U.S. Cl. ..... 273/302; 434/129
(58) Field of Search ..... 273/292, 299, 273/302, 303, 304, 307, 308; 434/129

(56) References Cited

U.S. PATENT DOCUMENTS 1,557,824 A * 10/1925 Fritz ..... 273/296
5,417,432 A * 5/1995 Dwyer ..... 273/299
5,524,899 A 6/1996 Haqedorn
5,607,162 A * 3/1997 Boylan et al. ..... 273/292
5,772,212 A 6/1998 Hagedorn
5,863,043 A * 1/1999 Bitner ..... 273/299
5,906,492 A * 5/1999 Putterman ..... 434/169
5,951,297 A 9/1999 Schwartz
6,036,190 A 3/2000 Edmunds et al.
6,050,569 A 4/2000 Taylor
6,109,609 A 8/2000 Ekberg
6,276,940 B1 * 8/2001 White ..... 434/172
6,371,483 B1 4/2002 Edmunds et al.
6,575,468 B1 * 6/2003 Hall ..... 273/298
6,651,984 B1 * 11/2003 Luken ..... 273/292

* cited by examiner

*Primary Examiner*—Kurt Fernstrom
(74) *Attorney, Agent, or Firm*—Baker & McKenzie LLP

(57) ABSTRACT

Disclosed herein are methods for playing a card game, as well as decks of cards for use with a card game, wherein the object of the game is for one of a plurality of players to discard all cards dealt to him before the others players. One embodiment of a method includes providing a deck of cards having a plurality of playing cards. Each of the plurality of playing cards has at least one visual indicium displayed on it, wherein the playing cards collectively have a plurality of visual indicia displayed on them. The method also includes dealing at least one of the plurality of deck of cards to each of the plurality of players, and selecting at least one of the plurality of visual indicia for matching the dealt cards. In this embodiment, the method further includes discarding one of the dealt cards by each of the plurality of players in a predetermined manner in response to the selecting of the at least one of the plurality of visual indicia. The discarded cards face up in order to reveal its corresponding visual indicium. Also, the method includes striking one of the discarded cards by each of the plurality of players when the revealed visual indicia of the discarded card matches the selected at least one visual indicium. Moreover, the method includes collecting all of the discarded cards by the last one of the plurality of players to strike the discarded card matching the selected at least one visual indicium.

10 Claims, 2 Drawing Sheets

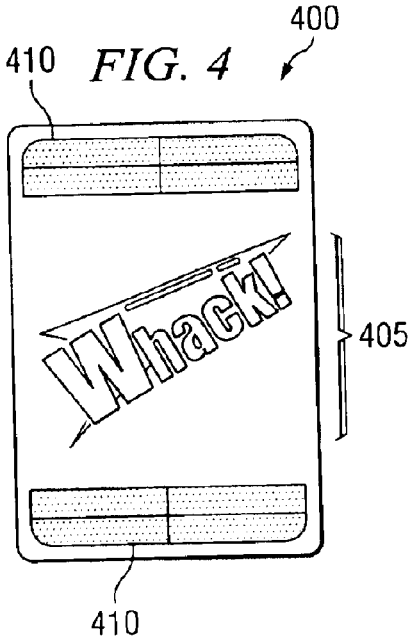
FIG. 4
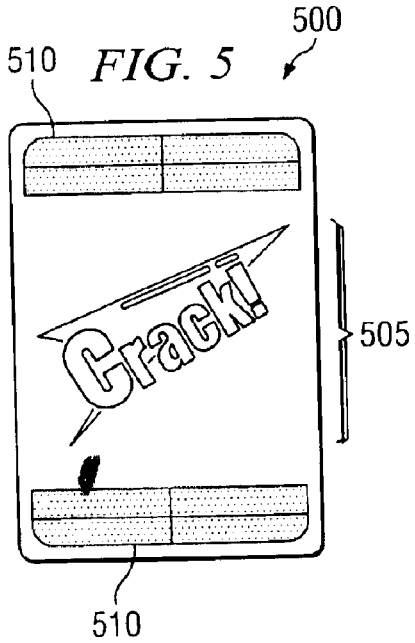
FIG. 5
FIG. 6
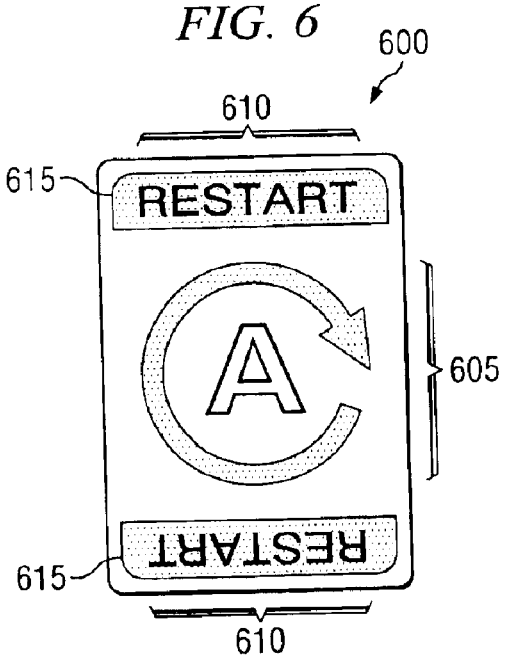

MATCHING CARD GAME AND METHOD FOR PLAYING THE SAME

CROSS-REFERENCE TO RELATED APPLICATION

This Application claims the benefit of U.S. Provisional Application Ser. No. 60/412,938, filed Sep. 19, 2002, and commonly assigned with the present application and incorporated herein by reference for all purposes.

TECHNICAL FIELD

Disclosed embodiments herein relate generally to card games, and more particularly to a matching card game for use as an educational tool employing a deck of cards imprinted with different visual indicia.

BACKGROUND

Playing cards have been in use for many years as a form of entertainment. In additional to their role of providing entertainment, it has become common practice to use playing cards as an educational tool.

A child can learn the alphabet, numbers, colors, and other elements of sets by associating the elements with previously learned elements or simply by matching an element with an identical element. The limited attention span of a small child, however, often provides a hurdle to learning in this manner. Therefore, it is recognized that some form of entertainment coupled with an educational process is highly beneficial to the learning process. As such, there is a need to have a card game, which can be played for entertainment, and concurrently teach and reinforce educational learning, such as improving memory recall and teaching the alphabet, as well as enhancing the reflexes.

BRIEF SUMMARY

Disclosed herein are methods for playing a card game, as well as decks of cards for use with a card game, wherein the object of the game is for one of a plurality of players to discard all cards dealt to him before the others players. One embodiment of a method includes providing a deck of cards having a plurality of playing cards, where each of the plurality of playing cards has at least one visual indicium displayed on it, wherein the playing cards collectively have a plurality of visual indicia displayed on them. The method also includes dealing at least one of the plurality of deck of cards to each of the plurality of players, and selecting at least one of the plurality of visual indicia for matching the dealt cards. In this embodiment, the method further includes discarding one of the dealt cards by each of the plurality of players in a predetermined manner in response to the selecting of the at least one of the plurality of visual indicia, where the discarded cards face up in order to reveal its corresponding visual indicium. Also, the method includes striking one of the discarded cards by each of the plurality of players when the revealed visual indicia of the discarded card matches the selected at least one visual indicium. Moreover, the method includes collecting all of the discarded cards by the last one of the plurality of players to strike the discarded card matching the selected at least one visual indicium.

In another aspect, one embodiment of a deck of cards includes a plurality of playing cards for displaying visual indicia, where at least one of the deck of cards is adapted to be dealt to each of the plurality of players. The deck of cards further includes a plurality of predetermined visual indicia wherein at least one of the plurality of visual indicia is adapted to be selected for matching the dealt cards, and wherein at least one of the plurality of visual indicia is displayed on a corresponding one of the playing cards and adapted to be revealed when a dealt card is discarded facing up by one of the plurality of players in a predetermined manner when the at least one of the plurality of visual indicia is selected for matching. In this embodiment, the discarded dealt cards are adapted to be struck by each of the plurality of players when the revealed at least one visual indicium on one of the discarded dealt cards matches the at least one of the plurality of visual indicia selected for matching the dealt cards, and further adapted to be collected by the last one of the plurality of players to strike the one discarded dealt card.

Details of one or more embodiments of the invention are set forth in the description below. These embodiments are for illustrative purposes only and the principle of invention can be implemented in other embodiments. Other features and advantages of this invention will become apparent from the following description.

BRIEF DESCRIPTION OF THE DRAWINGS

It is emphasized that various features or components in the drawings included herein may not be illustrated for clarity of discussion. With this in mind, reference is now made to the following descriptions taken in conjunction with the accompanying drawings, in which:

FIG. 4 illustrates one embodiment of a command card having a command to strike display thereon;

FIG. 5 illustrates one embodiment of a command card having a misleading command displayed thereon; and FIG. 6 illustrates one embodiment of a command card having a restart command displayed thereon.

DETAILED DESCRIPTION OF PREFERRED EMBODIMENTS

Figure 1:
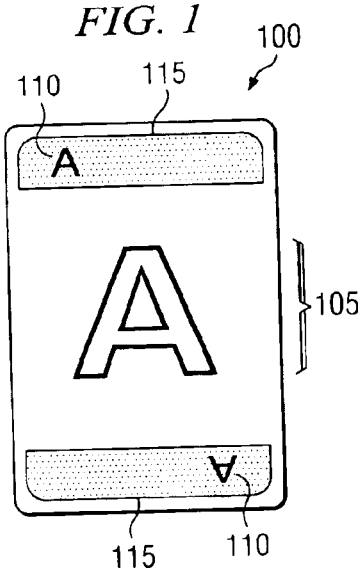
FIG. 1 illustrates one embodiment of a playing card displaying a plurality of visual indicia for use in connection with the card game disclosed herein.

An embodiment of a playing card 100 for displaying a plurality of visual indicia 105 for use in connection with methods for playing a card game as described herein is depicted in FIG. 1. According to one embodiment, the visual indicium 105, which may be predetermined, includes the letters of the alphabet. Specifically, each letter of the alphabet is individually displayed on a separate playing card. In related embodiments, more than one letter of the alphabet (or even complete words) may be included on each playing card 100, as well as letters (or words) from the alphabets of non-English languages. Utilizing the letters of the alphabet will help improve the players' recognition of letters, which in turn will enhance reading, writing and spelling skills. While letters of the alphabet are displayed on the playing cards in the illustrated embodiment, other types of visual indicia could also be utilized, such as numbers, pictures, characters, signs or colors.

In other embodiments, a color bar may be located on at least one end of the playing card 100. More specifically, in the illustrated embodiment in FIG. 1, a color bar 115 is shown on both ends of the playing card 100. The color bar 115 can be used as another visual indicator for use in the card game described herein by associating a specific color with the visual indicium 105 on certain playing cards 100. Other examples of employing colors on the playing card 100 are discussed below.

According to one embodiment, the visual indicium 105 is located in the center of the playing card 100. In the embodiment displayed in FIG. 1, supplemental visual indicia 110 are displayed on opposing ends of the corresponding playing card 100, wherein the top edge of each of the supplemental indicium 110 is oriented to be adjacent to the top and bottom edges of the playing card 100, respectively. The embodiment displayed in FIG. 1 allows the visual indicium 105 and supplemental visual indicia 110 to be easily read regardless of the orientation of the playing card 100. While the playing card 100 in FIG. 1 displays the supplemental visual indicia 110 in the top left and bottom rights comers of the playing card 100, it is contemplated that the supplemental visual indicia 110 can be located in other areas of the playing card 100. For example, the supplemental visual indicia 110 can be located in the top right and bottom left corners of the playing card 100, in the top and bottom left corners of the playing card 100 or in the center of the opposing ends of the playing card 100.

The visual indicium 105 can be selected in either a random or preset sequence. For example, a preset sequence would be alphabetical or numerical order, e.g., "A, B, C, D." or "1, 2, 3, 4." It is contemplated that if alphabetical order is selected as a preset sequence, some or all of the letters of the alphabet can be used. A random sequence includes, but is not limited to, a set of colors, pictures, symbols, and the like. For example, if the visual indicium 105 are comprised of colors, the order may be red, green, blue and then yellow. Another example of a random sequence would include letters or numbers in a random order, such as "D, G, A, C, B" or "3, 5, 2, 4, 1."

In a particularly advantageous embodiment, the visual indicium 105 is a letter of the alphabet, wherein a letter of the alphabet is individually displayed on a separate playing card. Another embodiment may contain more than one card displaying the same letter or other visual indicia. For example, the deck of cards may contain about three identical groups of the playing cards displaying the visual indicia. Where the visual indicium is each of the letters of the alphabet, such a deck of cards would now contain a total of 78 playing cards displaying three sets of the letters of the alphabet. Of course, if a non-English alphabet having more or less than 26 letters is used as the visual indicia, a deck using three sets letters will have a greater or lesser number of cards than an English alphabet deck of cards.

Figure 2:
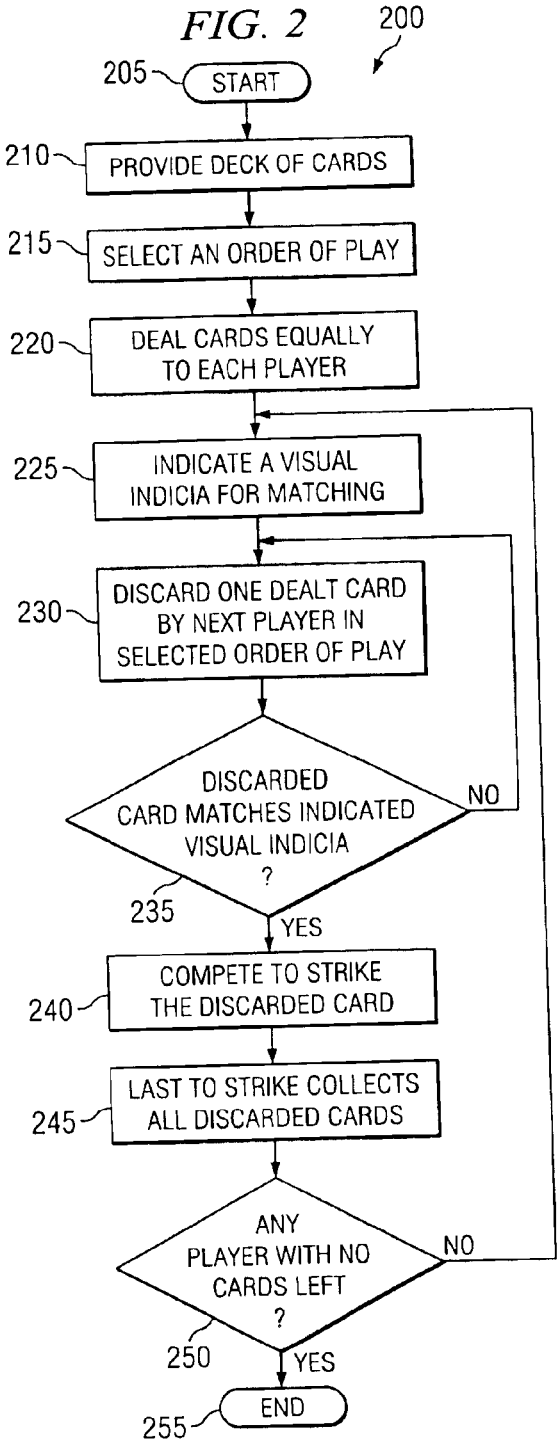
FIG. 2 illustrates a flow diagram of one embodiment of a method of playing the card game disclosed herein.

There are several alternative methods for playing a game using the various decks of cards described herein, where the object of the game is to be the first player to discard all of the cards he or she possesses. Illustrated in FIG. 2, is a flow diagram 200 of one embodiment of such a method. It should be understood that the process flow of playing a card game described with reference to FIG. 2 is only one example of a method conducted according to the principles disclosed herein, and other methods, while still conducted according to these principles and within the scope of the present disclosure, may include a greater or lesser number of steps.

In the illustrated embodiment, a group of players decides to play the game at a start block 205. At block 210, a deck of cards having a plurality of playing cards, such as the playing card 100 illustrated in FIG. 1 is provided for the players. Once the cards have been provided, the method moves on to block 215 where an order of play is determined. In a specific embodiment, the order of play refers to the order in which the players will discard their individual cards during game play.

After the order has been determined, the cards are dealt to each player, where each player receives at least one of the dealt cards at block 220. In a specific embodiment, each player receives an equal number of dealt cards, however an equal number of cards may not be dealt to each player if the number of players is not evenly dividable into the total number of cards in the deck. At block 225, at least one visual indicium that will be used for matching the dealt cards is indicated to the players. In an exemplary embodiment, the players select at least one of the visual indicia displayed on the playing cards that will be used to match the dealt cards. For example, as the game progresses, before each player discards a dealt card in an attempt to match the selected visual indicium, the player whose turn it is to discard may indicate the visual indicium to be matched. In a related embodiment, the order of play set forth in block 215 may also be used to determine the player who indicates the visual indicia to be matched during game play. In such embodiments, the visual indicia may be selected according to a predetermined list or order, or may simply be selected as the choice of the player whose turn it is.

At block 230, once the visual indicia for matching has been selected, regardless of the process of selection, the player whose turn it is then discards one of his dealt cards so that the discarded card reveals the corresponding visual indicia displayed thereon. Then, at a decision block 235, it is determined whether the indicia on the discarded card matches the selected indicia. If the indicia on both do not match, the method returns to block 230 where another card is discarded by the next player in the predetermined order of play. However, if it is determined at block 235 that the indicia on both do match, the method moves to block 240. At block 240, the players compete to be the first to strike the discarded card that matches the selected indicia. The last player to strike the discarded card is required to collect all of the discarded cards, at block 245. In one embodiment, it is contemplated that the visual indicia displayed on the playing cards will remain hidden from view of the players until the discarding takes place.

In a specific example of a round of game play, the players can agree to a predetermined list of visual indicia, such as "A, B, C, D, E." In such case, the letter "A" is the first selected visual indicium. In one embodiment, each player will verbalize one of the selected visual indicia that is next in the predetermined sequence before discarding a card. For example, the first player will say "A" before discarding his or her card. The next player will say "B" before discarding his or her card. This sequence will continue until the visual indicium displayed on a discarded card matches the selected indicium and the players strike the discarded card. In an alternative embodiment, the players can randomly select the indicia for matching to the discarded cards as the game progresses. For instance, the first player may say "G" before discarding his or her card. The next player may say "B" before discarding his or her card. Each player will continue to randomly select a letter prior to discarding a card until the visual indicium displayed on a discarded card matches at least one of the selected indicia and the players compete to strike the discarded card. In yet another embodiment, an indicator card is employed to begin game play so that the players match the indicator card with the discarded cards rather than verbalizing to start the predetermined sequence.

Moving on to block 250, after the players have competed to strike the matching discarded card, it is determined whether any player has no cards left in his hand. If there a player without any further cards, that player is declared the winner of the game, and the method then ends at an end block 255. However, if it is determined at block 250 that there is no player that is free of any further cards, then the method returns to block 225 where the next visual indicium selected for matching the discarded cards is indicated using any of the above techniques. It is further contemplated that when a card is discarded, one or more players will mistakenly strike the discarded card when the selected indicium does not match the indicium displayed on the discarded card. In such case, the first player to mistakenly strike the discarded card is required to collect all of the discarded cards. As discussed above, however, each player's goal is to discard all of the cards he possesses.

Figure 3:
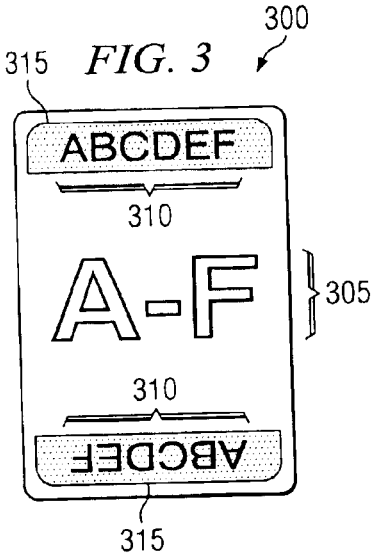
FIG. 3 illustrates one embodiment of a wild card displaying a group of several of the plurality of visual indicia for use in connection with the card game disclosed herein.

Turning now to FIG. 3, illustrated is a wild card 300 for use with the deck of cards disclosed herein. As shown in FIG. 3, the wild card 300 may have a group of visual indicia 305 displayed thereon. In the embodiment displayed in FIG. 3, the visual indicia 305 on the wild card 300 is a group of letters in alphabetical sequence. However, it is contemplated that the group of visual indicia 305 can be in a predetermined sequence, such as "A, B, C, D" or "1, 2, 3, 4," or in a random order, such as "A, C, G, B, E" or "5, 2, 7, 3, 1." In a related embodiment, a plurality of wild cards may be employed and each include different sequences of letters of the alphabet. For example, one wild card may include "ABCDEF," while another includes "GHIJKLM," another includes "NOPQRST," and yet another includes "UVWXYZ."

In the embodiment illustrated in FIG. 3, supplemental visual indicia 310 are displayed on opposing ends of the wild card 300, wherein the top edge of each of the supplemental indicia 310 is oriented to be adjacent to the top and bottom edges of the wild card 300, respectively. As with the supplemental visual indicia 110 in FIG. 1, employing the supplemental visual indicia 310 on the wild card 300 allows the visual indicia 305 on the wild card 300 to be understood by reading the supplemental visual indicia 310 from varying directions, regardless of the orientation of the wild card 300. Also as before, while the wild card 300 displays the supplemental visual indicia 310 in the top left and bottom rights comers of the wild card 300, it is contemplated that the supplemental visual indicia 310 can be located in other areas of the wild card 300.

In one embodiment, the wild card 300 includes at least one color bar 315 on an end of the wild card 300. It is contemplated that identical wild cards will include at least one color bar 315 of the same color, while dissimilar wild cards will include at least one color bar 315 of a different color. For example, the color bar on a first wild card is red, the color bar on a second wild card is yellow, the color bar on a third wild card is blue and the color bar on a fourth wild card is green. In another embodiment, the color bar 315 on the wild card 300 is identical in color to the color bar on the playing cards containing the individual visual indicium that are included in the group of visual indicia 305 displayed on the wild card 300. For example, if a wild card, such as the wild card 100 in FIG. 1, includes the group of visual indicia "A, B, C, D, E, F" and the color bar on the wild card is red, then the color bar on the each of the playing cards displaying the individual letters "A, B, C, D, E or F" will also be red.

Alternative embodiments of the card game described herein utilizes at least one wild card in the deck of cards. In such embodiments, the players will strike the discarded cards when the selected visual indicium is included in the revealed group of visual indicia on a discarded wild card. For example, if a wild card including "A, B, C, D, E, F" as its group of visual indicia is discarded, the players will strike the wild card if the visual indicium selected for matching is "A, B, C, D, E or F."

Looking now at FIG. 4, illustrated is an embodiment of a command card 400 having a command to strike 405 displayed thereon. Inclusion of the command card 400 is to alert the players to strike or hit the discarded cards when the command card 400 is discarded. As shown in FIG. 4, one embodiment of the command card 400 displays the word "Whack" as the visual indicium 405 displayed thereon. However, it is contemplated that other words or phrases with a similar meaning, such as "Strike," "Hit," "Smack" or "Slap" may be used. In one embodiment of the game described herein, the deck of cards includes one or more command cards 400 having a command to strike displayed thereon. In this embodiment, the chance for the players to strike the discarded card when a command card 400 having a command to strike 405 displayed thereon is discarded is increased. As before, the last player to strike the discarded command card having a command to strike collects all of the discarded cards.

Furthermore, the command card 400 may also include a color bar 410, as illustrated in FIG. 4. In one embodiment, the color bar 410 may include a plurality of colors either randomly selected or selected based on color bars included on some or all of the playing cards. For example, if four different color bars are used on the collection of playing cards, perhaps indicating the division of the list of visual indicia into four sequential groups, the color bar 410 of the command card 400 may include those four different colors. Of course, a deck of cards according to the principles disclosed herein is not limited to any particular colors, or even the use of the color bar 410 at all, on the command card 400. Moreover, the command card 400 may also include a supplemental command to strike (not illustrated) in the color bar 410, as found on other cards described herein, for easy reading the command to strike regardless of card orientation.

Another embodiment of a command card 500 is depicted in FIG. 5. Specifically, the command card 500 shown in FIG. 5 has a misleading command 505 displayed thereon. As shown in FIG. 5, the misleading command card 500 in one embodiment displays the word "Crack" 505. However, it is contemplated that other words or phrases may be used on the misleading command card 500 for the misleading command. In an advantageous embodiment, the word or phrase used on the misleading command card 500 is selected depending on the word or phrase displayed on a command card having a command to strike displayed thereon, such as the command card 400 in FIG. 4. Specifically, the misleading command 505 may be similar to the command to strike such that the misleading command 505 confuses or tricks one or more of the players into mistakenly striking the discarded misleading command card 500 card during game play. For example, the misleading command 505 may be similar in sound or sight to the command to strike, e.g., rhymes or contains the same first letter. In other embodiments, the misleading command 510 may include the command to strike therein. For example, the misleading command 510 may be "Do not Whack!" when the command to strike is "Whack!" Of course, a deck of cards as disclosed herein, or a card game employing such a deck of cards, is not limited to any particular commands.

Moreover, the misleading command card 500 may also include a color bar 510, as illustrated in FIG. 5. As with the command card 400 in FIG. 4, in one embodiment, the color bar 510 may include a plurality of colors either randomly selected or selected based on color bars included on some or all of the playing cards. Thus, if four different color bars are used on the collection of playing cards, perhaps indicating the division of the list of visual indicia into four sequential groups, the color bar 510 of the misleading command card 500 may include those four different colors. However, also as before, a deck of cards according to the principles disclosed herein is not limited to any particular colors, or even the use of the color bar 510 at all, on the misleading command card 500. Furthermore, the command card 500 may also include a supplemental misleading command (not illustrated) in the color bar 410, as found on other cards described herein, for easy reading the misleading command regardless of card orientation.

Turning finally to FIG. 6, illustrated is one embodiment of a command card 600 having a restart command 605 displayed thereon. As shown in FIG. 6, one embodiment of the command card 600 displays a restart command 605 using a letter "A" surrounded by a circular arrow". However, it is contemplated that other symbols, figures, or even words with a similar meaning may be used as the restart command 605, such as the words "Repeat," "Start Over" or "Start Again".

The embodiment of the command card 600 in FIG. 6 also includes a supplemental restart command 610 on opposing ends of the command card 600. As shown, the top edge of each of the supplemental restart command 610 is oriented to be adjacent to the top and bottom edges of the command card 600, respectively. As discussed above, employing the supplemental restart command 610 allows the restart command 605 on the command card 600 to be more easily understood by reading the supplemental restart command 610 from varying directions, regardless of the orientation of the command card 600.

In one embodiment of the game described herein, the deck of cards includes one or more command cards having the restart command 605 displayed thereon, such as the command card 600 illustrated in FIG. 6. In such embodiments, when one of the discarded cards reveals the restart command 605, the order of the selection of visual indicia for matching the dealt cards is restarted. In other embodiments, it is further contemplated that the command card 600 may display the command "Reverse," or a symbol for the restart command 605 depicting that reverse of the selection order is required, so that the order of play is reversed.

Furthermore, the command card 600 may also include a color bar 615, as illustrated in FIG. 6. Like the color bars described above with respect to FIGS. 4 and 5, the color bar 615 may include a plurality of colors either randomly selected or selected based on color bars included on some or all of the playing cards. Thus, if four different color bars are used on the collection of playing cards, perhaps indicating the division of the list of visual indicia into four sequential groups, the color bar 615 of the command card 600 may include those four different colors. Of course, a deck of cards according to the principles disclosed herein is not limited to any particular colors, or even the use of the color bar 615 at all, on the command card 600.

While various embodiments of methods for playing a card game, as well as decks of cards constructed according to the principles disclosed herein, have been described above, it should be understood that they have been presented by way of example only, and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention (s), and their equivalents, that are protected thereby. In all instances, the scope of the claims shall be considered on their own merits in light of the specification, but should not be constrained by the headings set forth herein.

What is claimed is:

1. A method for playing a card game, wherein the object of the game is for one of a plurality of players to discard all cards he possesses before the others of the plurality, the method comprising:

providing a deck of cards having a plurality of playing cards, each of the plurality of playing cards having at least one visual indicia displayed on it, wherein the playing cards collectively have a plurality of visual indicia displayed on them;

dealing at least one of the plurality of deck of cards to each of the plurality of players;

selecting at least one of the plurality of visual indicia for matching the dealt cards;

discarding one of the dealt cards by each of the plurality of players in a predetermined manner in response to the selecting of the at least one of the plurality of visual indicia, the discarded cards facing up in order to reveal its corresponding visual indicia;

striking one of the discarded cards by each of the plurality of players when the revealed visual indicia of the discarded card matches the selected at least one visual indicia; and collecting all of the discarded cards by the last one of the plurality of players to strike the discarded card matching the selected at least one visual indicia.

2. A method according to claim 1, wherein the discarding in a predetermined manner comprises a first of the plurality of players discarding a first dealt card in response to selecting a first visual indicia, and a second of the plurality of players discarding a second dealt card in response to selecting a second visual indicia when the visual indicia displayed on the first dealt card does not match the first visual indicia.

3. A method according to claim 1, wherein providing comprises providing a deck of cards having a plurality of playing cards, each of the plurality of playing cards having at least one letter of an alphabet displayed on it, wherein the playing cards collectively have a plurality of letters of an alphabet displayed on them.

4. A method according to claim 1, wherein the collecting further comprises collecting all of the discarded cards by the one of the plurality of players that strikes the discarded card when the revealed visual indicia does not correspond to the selected one of the plurality of visual indicia.

5. A method according to claim 1, wherein providing further comprises providing a deck of cards having at least one wild card having a group of the plurality of visual indicia displayed on it, the striking further comprising striking the discarded wild card by each of the plurality of players when the selected one of the plurality of visual indicia corresponds to one of the revealed group of visual indicia on the discarded wild card.

6. A method according to claim 1, wherein providing further comprises providing a deck of cards having at least one command card having a command to strike displayed on it, the striking further comprising striking the discarded command card having the command to strike by each of the plurality of player when the discarded command card reveals the command to strike displayed thereon.

7. A method according to claim 6, wherein providing further comprises providing a deck of cards having at least one command card having a misleading command displayed on it, and wherein the collecting further comprises collecting all of the discarded cards by the first one of the plurality of players to strike the discarded command card having the misleading command displayed thereon.

8. A method according to claim 1, wherein providing further comprises providing a deck of cards having at least one command card having a restart command displayed on it, the selecting further comprising selecting at least one of the plurality of visual indicia for matching the dealt cards in a predetermined order, and restarting the order when the command card having the restart command displayed thereon is discarded.

9. A method according to claim 1, wherein providing further comprises providing a deck of cards having a plurality of playing cards for displaying a plurality of corresponding predetermined visual indicia, each of the plurality of playing cards further including supplemental indicia corresponding to the visual indicia displayed thereon and each displayed proximate opposing ends of each corresponding playing card, a top edge of each of the supplemental indicia oriented to be adjacent to edges of the corresponding playing card at each of the opposing ends.

10. A method according to claim 1, further comprising hiding the visual indicia displayed on the playing cards from view of the plurality of players until the discarding.

* * * * *